US005183346A

United States Patent [19]

Tesar

[11] Patent Number: 5,183,346

[45] Date of Patent: Feb. 2, 1993

[54] KEYCAP OVERLAY SNAP-ON SYSTEM

[76] Inventor: Herbert Tesar, 3382 Capital Circle NE., Tallahassee, Fla. 32308

[21] Appl. No.: 883,530

[22] Filed: May 15, 1992

[51] Int. Cl.[5] ..... B41J 5/08; B41J 5/10

[52] U.S. Cl. ..... 400/490; 400/491; 400/493

[58] Field of Search ..... 400/490, 491.1, 495, 400/491.2, 491.3, 494, 493, 492, 491

[56] References Cited

U.S. PATENT DOCUMENTS

| | | | |
|---|---|---|---|
| 563,167 | 6/1896 | Graham et al. | 400/491.1 |
| 974,488 | 11/1910 | Hay | 400/491 |
| 3,317,019 | 5/1967 | Braune | 197/98 |
| 3,848,723 | 11/1974 | Hogue | 400/490 |
| 3,871,506 | 3/1975 | Von Luders | 197/98 |
| 4,185,282 | 1/1980 | Pick | 340/711 |
| 4,512,092 | 4/1985 | McLaughlin et al. | 400/493 |
| 4,755,072 | 7/1988 | Hoornweg | 400/490 |
| 4,906,117 | 3/1990 | Birdwell | 400/490 |

FOREIGN PATENT DOCUMENTS

| | | | |
|---|---|---|---|
| 2463007 | 3/1981 | France | 400/493 |
| 2009047 | 6/1979 | United Kingdom | 400/491.3 |
| 2152437 | 8/1985 | United Kingdom . | |

*Primary Examiner*—Edgar S. Burr
*Assistant Examiner*—Anthony H. Nguygen
*Attorney, Agent, or Firm*—Franklin J. Cona

[57] ABSTRACT

A system for converting graphic symbols on a computer data entry keyboard to another set of graphic symbols such as a foreign language or scientific symbols or mathematical notations is disclosed. The system comprises a plurality of individual keycaps, each keycap being sized for fitting over the upper surface of a single data entry key on the computer data entry keyboard. Each keycap has two indicia inscribed thereon. The first indicia, corresponding to the graphic symbol to be displayed upon the skriking of the data entry key is inscribed on the upper exterior surface of the keycap. The second indicia, corresponds to the graphic symbol on the upper surface of the data entry key over which the keycap is positioned. A cabinet having a columnar orientation for receiving the keycaps in a stacked relationship when the keycaps are not in use and operation is also disclosed. A lid protects the keycaps when they are stored in the cabinet.

8 Claims, 2 Drawing Sheets

KEYCAP OVERLAY SNAP-ON SYSTEM

BACKGROUND OF THE INVENTION

1. Field of the Invention

The present invention relates to a system for converting the graphic symbols on a computer data entry keyboard to another set of graphic symbols such as a foreign language or a set of scientific symbols. In particular, the invention relates to a system for altering the keyboard of a computer data entry key to facilitate typing in a foreign language or a particular set of scientific notation. The system also includes a set of software programs to instruct the computer display device and the computer print out device to print the graphic symbol on the upper surface of the keycap whenever the corresponding data entry key upon which it is positioned is struck.

The present invention relates to a system for changing a graphic symbols represented on a computer data entry keyboard. More particularly, the system relates to a plurality of keycap overlay's for fitting over the individual keys of the computer data entry keyboard and changing the graphic indicia displayed on the computer screen and the computer print out device. In the United States, most keyboards for computer data entry come equipped with a conventional "querty" alphabetic graphic symbol arrangement. In certain cases, it would be desirable to alter the graphic symbol on each key of the computer data entry keyboard. For example, a person might wish to insert a letter from a foreign language, a mathematical symbol or a chemical formulation symbol depending upon the use and the intended application.

2. Description of the Background Art

Throughout the United States steps are being taken to improve the efficiency and effectiveness of the computer data entry keyboard for use in applications other than typing English characters. In particular, systems are being developed to allow the computer user to key in symbols and letters in a foreign language such as French or German. Also, steps are being taken to allow users to key in special series of notations such as chemical formulations or mathematical or astrophysical symbols.

The present invention relates to a plurality of keycaps that are stackable and storable, one upon the other, in a rectangular cabinet when not in use and operation. A lid is provided to close the cabinet after the keycaps are stored to protect the keycaps from damage when not in use. The cabinet is made from a plastic material, preferably a transparent plastic. In use and operation, the computer user would select the appropriate cabinet for the intended application. For example, if the computer user wished to enter German alphabetic characters, the person would select the cabinet with the German alphabetic keycaps contained therein. The user would then remove one keycap at a time from the stack and observe the indicia on the underside of the keycap. That indicia would correspond to the indicia on the corresponding data entry key over which the keycap is to be positioned. The keycap has the German alphabetic symbol on the top exterior surface of each keycap. The computer user would merely insert the keycap over the corresponding data entry key with a slight downward pressure. Each keycap has a series of lugs on an inner surface to maintain an air gap between the interior surface thereof and the exterior side wall surface of the computer data entry key. This allows air flow in the separation and facilitates removal of the keycap when the user wishes to convert the data entry keyboard to another set of symbols or its original English language orientation. Each keycap is made from a plastic material, preferably opaque material and is sized to provide sufficient spacing between the adjacent keycaps when the keycap is depressed.

When all the keycaps have been installed on the correct data entry keys, the computer user then executes a set of software programs to instruct the computer display and print out device to indicate and display the first indicia on the upper side of the keycap whenever the data entry key holding that keycap is struck. Many attempts have been made in the past to convert a computer data entry key for typing of characters of different languages, alphabets and scientific notation such as chemical formulations, astrophysical symbols, or any articulation, impression or expression used to represent in an abstract form.

Most attempts at solving the problem involved using cumbersome tables with the data entry person having to constantly take their eyes off the keyboard to look up the appropriate symbol or English character that corresponded to the desired character that should be struck. This has led to errors and decreased efficiency of the person at the computer keyboard.

For example, U.S. Pat. No. 3,317,019 issued to Braune discloses a keyboard overlay comprised of a collection of joined keycaps for use with foreign languages.

U.S. Pat. No. 3,871,506 issued to Von Luders discloses a keyboard overlay comprised of a collection of separate keycaps for use with foreign languages.

U.S. Pat. No. 4,512,092 issued to McLaughlin et al discloses a keyboard overlay comprised of individual caps covering labels for highlighting keyboard indicia.

U.S. Pat. No. 4,755,072 issued to Hournweg discloses individual plastic keycaps that fit over existing keys.

U.S. Pat. No. 4,185,282 issued to Pick discloses a keyboard device having a computer operated language selector for keys.

Patent GB 2,152,437 issued to Polarschek discloses a keyboard overlay sheet for use with various languages.

None of the references teach or even suggest the inscription of a graphic indicia on an inner surface of the individual keycap.

None of these previous efforts, however, provide the benefits intended with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

Therefore, it is an object of the present invention to provide a system for converting the graphic symbols on a computer data entry keyboard to another set of graphic symbols such as another language or scientific symbols.

It is a further object of the system to provide a keycap that is positionable over the data entry key and is removable with a slight motion of the persons fingers.

It is a still further object of the system to provide a keycap wherein the keycap is made from a resilient elastomeric opaque material.

Another object of the system is to provide a keycap wherein the surface of the keycap has a second indicia inscribed therein which corresponds to the indicia of the keycap upon which it will be positioned.

It is a still final object of the system to provide a keycap that will maintain a separation between the interior surface of the side walls of the keycap and the exterior side walls of the computer data entry key to allow air to freely circulate therein and avoid having the keycap stick to the computer data entry key due to the vacuum effect if the separation were not maintained.

Although there have been many inventions related to keycap overlay snap-on systems, none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a system for converting graphic symbols on a computer data entry keyboard to another set of graphic symbols such as an another language or scientific symbols or the like. The system comprises a plurality of keycaps with each keycap being adapted for positioning over the upper surface of a data entry key on a conventional computer data entry keyboard. Each keycap has a top rectangular surface corresponding in size and shape to the upper exterior surface of the data entry key over which it is to be positioned. The side walls of each keycap extend downwardly and flare outwardly from the top rectangular surface. The lower edge of each keycap has a rim that extends peripherally around the lower edge of the side walls of the keycap. A lug is positioned midway on the inner edge of each side of the rim for contacting the data entry key and for separating an inner surface of the keycap sidewall from the exterior of the data entry key over which it is to be positioned. Each keycap has a first indicia formed on the top rectangular surface that corresponds to the graphic symbol to be displayed upon the striking of the data entry key. Also, each keycap has a second indicia on an interior surface corresponding to the graphic symbol of the upper surface of the data entry key which it is to be positioned.

When not in use and operation, the keycaps are stacked in a vertical pile and inserted in an open cabinet. A lid fits over the open top of the cabinet and protects the stacked keycaps. The keycaps are stored in the cabinet.

Finally, the system includes software means to display the graphic symbols indicated by the first indicia on the computer display and print out devices.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Figure 1:
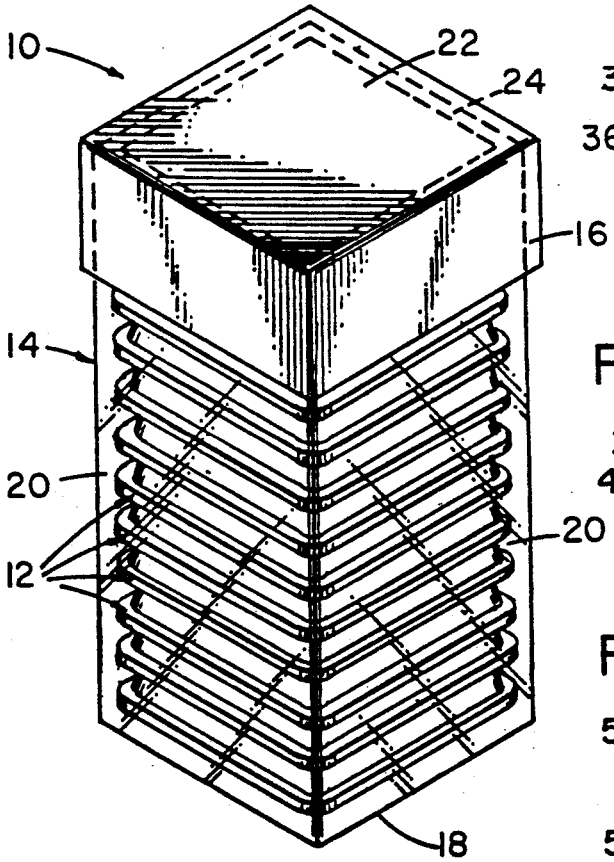
FIG. 1 is a perspective of the invention showing the keycaps in a stacked relationship within the cabinet and having the lid enclosing the stacked keycaps within the cabinet.

Referring specifically to FIG. 1, the invention comprises a system 10 having a plurality of keycaps 12 that are stackable, one upon the other and storable in a rectangular cabinet 14.

A lid 16 is used to close the top of the cabinet 14 after the keycaps 12 are stored to protect the keycaps 12 from damage when not in use. The cabinet 14 has a base 18, a plurality of sidewalls 20, and an open top end 22. The cabinet 14 and cabinet lid 16 are made from a plastic material, preferably a transparent plastic.

The lid 16 is sized to slide over the sidewalls 20 of the cabinet 14 and contact an upper edge 24 of each sidewall 20 to close the cabinet 14. This keeps the keycaps 12 in a stacked relationship which greatly facilitates the portability of the system 10 when traveling from one computer location to another. Also, the cabinet 14 keeps the keycaps 12 in a relatively clean environment when not in use.

Figure 2:
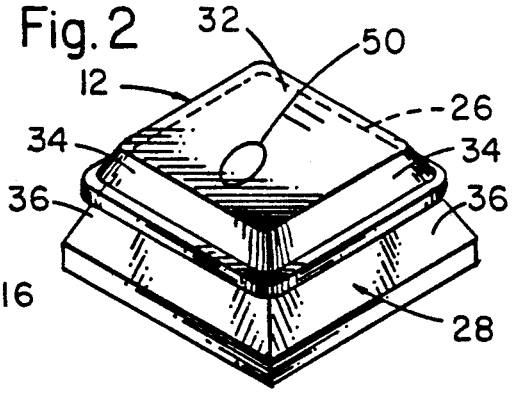
FIG. 2 is a perspective of a single keycap in the installed position on a data entry key.
Figure 3:
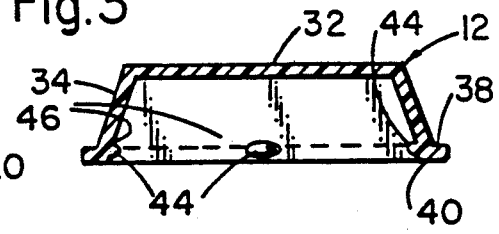
FIG. 3 is a cross sectional view of the keycap taken along lines 3—3 of FIG. 2.
Figure 6:
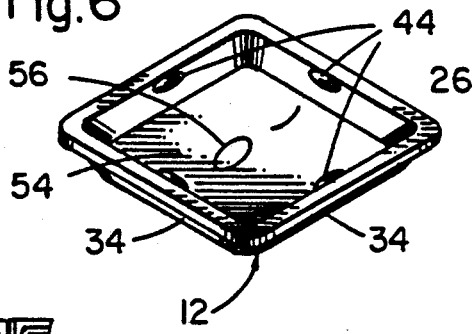
FIG. 6 is a bottom perspective view of a keycap showing the second indicia inscribed on an interior upper surface of the keycap.
Figure 5:
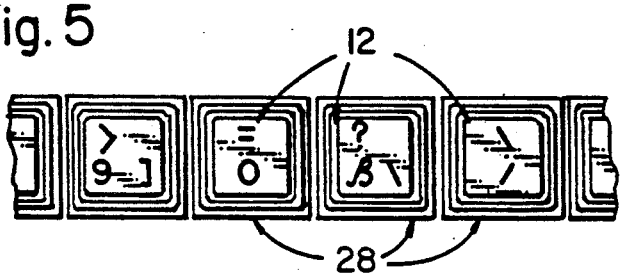
FIG. 5 is a top plan view of a plurality of keycaps showing the first indicia on the top surface of the keycap.

As best seen in FIGS. 2 and 3 each keycap 12 is shaped to fit over the upper portion 26 of a data entry key 28 on a computer data entry keyboard 30. The keycap 12 has a top rectangular surface 32, slightly larger than the upper portion 26 of the data entry key 28 over which the keycap 12 fits. The keycap 12 has a plurality of sidewalls 34 that extend downwardly and are flared outwardly to cover about half of the adjacent side of the data entry key 36.

The keycap 12 has a rim 38 on the lower edge 40 of the sidewalls 34 and the rim 38 extends outwardly peripherally throughout. The outward projection of the rim 38 greatly facilitates the installation and removal of the keycap 12 upon and from each data entry key 28 by giving the user a finger hold on the keycap 12.

Figure 4:
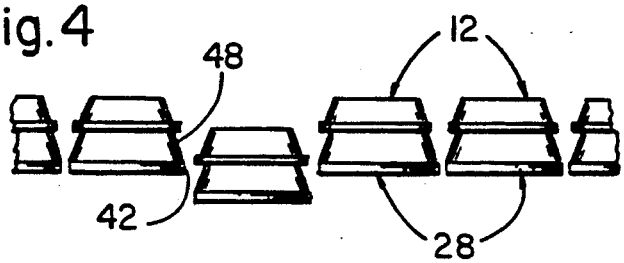
FIG. 4 is a elevation view of a series or a plurality of keycaps showing the relationship between each keycap and data entry key to the adjacent keycap and data entry key on a typical computer data entry keyboard.
Figure 7:
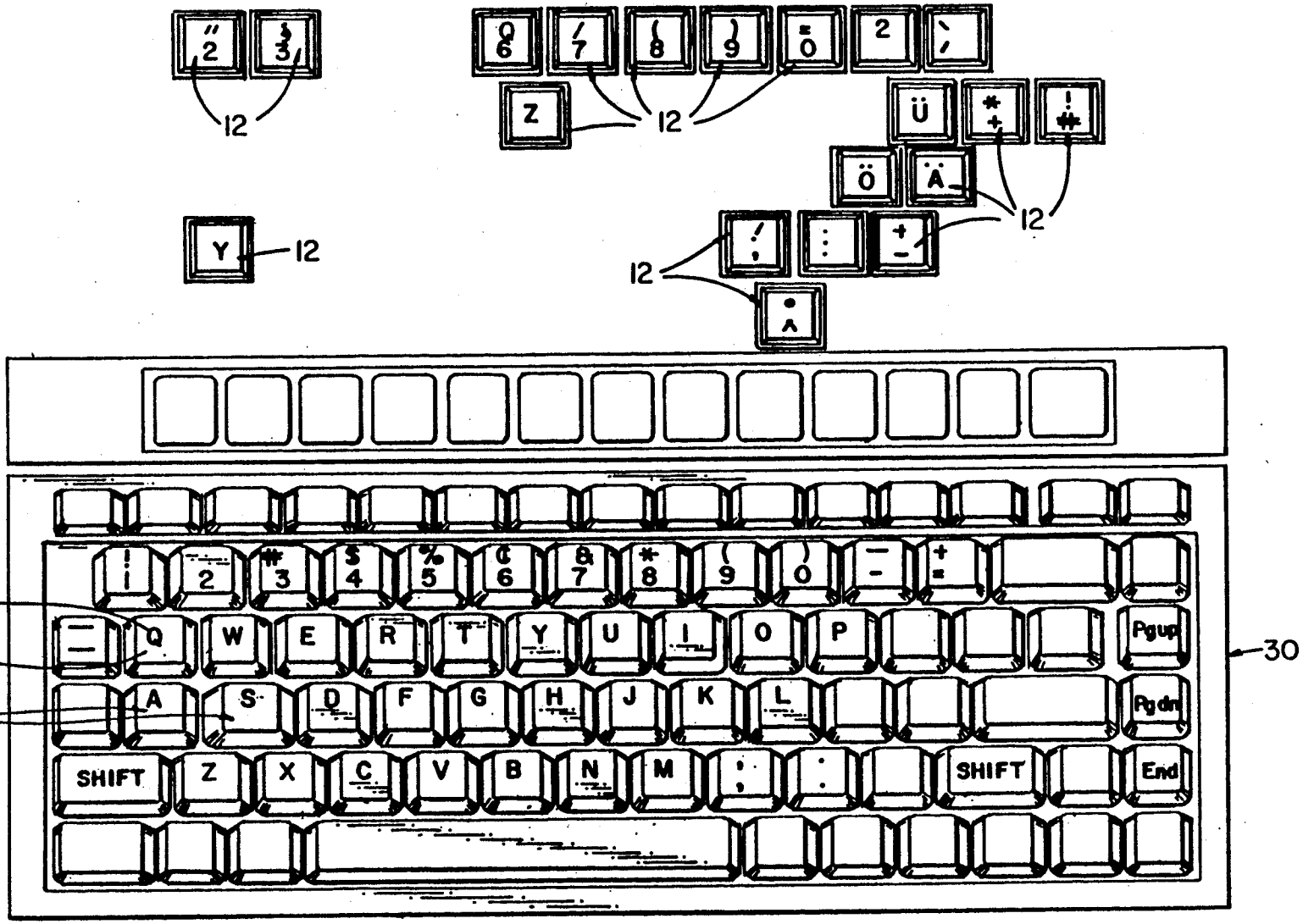
FIG. 7 is a top plan view of a typical computer data entry keyboard showing the keyboard in a conventional english setting in the lower portion and the keycaps with the first indicia printed thereon prior to installation on the data entry key in the upper portion.

As best seen in FIG. 4, the rim 38 is sized to clear the base 42 of the adjacent data entry keys 28 when the operator depresses the keycap 12. The keycap 12 is made from an opaque material, preferably a resilient elastomeric material. The resiliency of each keycap 12 greatly facilitates the installation and removal of each keycap 12. Further, the resiliency of each keycap 12 allows the keycap 12 to stretch slightly if pressed too hard during the installation process.

The rim 38 has a plurality of lugs 44 positioned equidistantly from each other on an inner edge 46 thereof. Each lug 44 engages a side 48 of the data entry key 28 to urge separation between the sidewalls 34 of the keycap 12 and the sides 48 of the data entry key 28. The separation or air-gap between the sidewalls 34 of the keycap 12 and the sides 48 of the data entry key 28 allow easy removal of the keycap 12. Without the lugs 44, the sidewalls 34 would snugly engage the sides 48 of the data entry key 28 and the removal of the keycap 12 would be hindered greatly. Further, if the data entry key 28 is wet or greasy, the lugs 44 keep the sidewalls 34 of the keycap 12 from contacting the wet or greasy sides 48 of the data entry key 28. Otherwise, the keycap 12 would stick to the data entry key 28.

The top rectangular surface 32 of the keycap 12 has a first indicia 50 corresponding to the graphic symbol 52 that will be printed upon the striking of the data entry key 28. The interior surface 54 of the keycap 12 has a second indicia 56 corresponding to the graphic symbol 52 on an upper surface 58 of the data entry key 28 that will receive the keycap 12.

Each set of keycaps 12 has a software program that contains the instructions to alter the computer display and printout devices to display and printout the first indicia 50 instead of the graphic symbol 52 on the upper surface 58 of a corresponding data entry key 28, respectively. For example, one set of keycaps 12 and programs would be used to convert the data entry keyboard 30 from the English language to the German language. Another set of keycaps **12*a* and programs would be used to convert the data entry keyboard 30 from the English language to a set of indicia 50*a*** for scientific notation.

In use and operation, the user removes the lid 16 from the cabinet 14 and installs the keycap 12 on the data entry key 28 on a one-by-one basis. The user determines the target data entry key 28 for each keycap 12 by noting the second indicia 56 on the interior surface 54 of the keycap 12 and then locating the data entry key 28 that has a graphic symbol 52 equal to the second indicia 56. The user then positions the keycap 12 on the target data entry key 28 and presses the top rectangular surface 32. The lugs 44 engages the sides 48 of the target data entry key 28 as the keycap 12 slides down over the upper portion 26 of the target data entry key 28.

After all the keycaps 12 are installed on the correct data entry keys 28 in this fashion, the user then executes a set of software programs that instruct the computer display and printout device to display the fist indicia 50 of the keycap 12 whenever the data entry key 28 holding that keycap 12 is struck.

Now that the invention has been described,

What is claimed is:

1. A system for converting the graphic symbols on a computer data entry keyboard to another set of graphic symbols such as another language of scientific symbols, the data entry keyboard having a plurality of data entry keys, said data entry keys having an upper exterior rectangular surface and downwardly extending sides, comprising in combination:

a plurality of keycaps, each keycap being adapted for positioning over the upper exterior surface of a data entry key on the computer data entry keyboard and adjacent to the downwardly extending sides of the data entry key, and having a top rectangular surface corresponding in size and shape to the upper exterior surface of the data entry key over which it is to be positioned, and further having a plurality of sidewalls extending downwardly and flared outwardly from the top rectangular surface for mateable receiving the adjacent sides of the data entry key to be covered, and a rim outwardly depending peripherally at a lower edge of the sidewalls, the rim having a plurality of lugs positioned midway on an inner edge thereof, for contacting the data entry key and further for separating an inner surface of the sidewall from the data entry key, each keycap having formed on the top rectangular surface thereof a first indicia corresponding to the graphic symbol to be displayed upon the striking of the data entry key, and still further having a second indicia on an interior surface thereof, the second indicia corresponding to the graphic symbol on the upper surface of the data entry key;

a cabinet having a size and shape adapted to receive the plurality of keycaps that are in a stacked relationship and an open top end for receiving the stacked keycaps; and a lid for protecting the plurality of stacked keycaps when stored in the cabinet, the lid being sized to overlap a plurality of sidewalls of the cabinet and having an interior surface adapted to engage an upper edge of the cabinet.

2. A system as recited in claim 1 wherein the cabinet is made from a plastic material.

3. A system as recited in claim 2 wherein the plastic material is transparent

4. A system as recited in claim 1 wherein each keycap is made from a opaque material.

5. A system as recited in claim 4 wherein the opaque material is a resilient elastomeric material.

6. A keycap for positioning over the upper surface of a data entry key of a computer data entry keyboard and adjacent to the downwardly extending sides thereof comprising a top rectangular surface corresponding in size and shape to the upper exterior surface of the data entry key over which it is to be positioned, a plurality of sidewalls extending downwardly and flared outwardly from the top rectangular surface for mateably receiving the adjacent sides of the data entry key to be covered, and a rim outwardly depending peripherally at a lower edge of the sidewalls, and having formed on the top rectangular surface thereof a first indicia corresponding to the graphic symbol to be displayed upon the striking of the data entry key, and still further having a second indicia on an interior surface, the second indicia corresponding to the graphic symbol on the upper exterior surface of the data entry key.

7. A keycap as recited in claim 6 wherein the rim further includes a plurality of lugs, each lug being positioned midway on an inner edge thereof for contacting the data entry key, and further for separating an inner surface of the sidewalls from the sides of the data entry key.

8. A keycap as recited in claim 7 wherein the second indicia is on an upper portion of the interior surface of the keycap.

* * * * *